United States Patent [19]

Uchimoto

[11] 4,022,082

[45] May 10, 1977

[54] DRIVING APPARATUS FOR OSCILLATION OF A MOLD WITHIN A CONTINUOUS CASTING MACHINE

[75] Inventor: Yoshikazu Uchimoto, Kobe, Japan

[73] Assignee: Kobe Steel Ltd., Kobe, Japan

[22] Filed: Oct. 14, 1975

[21] Appl. No.: 622,445

[30] Foreign Application Priority Data

Oct. 14, 1974 Japan ..... 49-118360
Oct. 13, 1974 Japan ..... 49-118361

[52] U.S. Cl. ..... 74/570; 74/805
[51] Int. Cl.[2] ..... G05G 1/00
[58] Field of Search ..... 74/570, 805, 804, 665 R, 74/116, 117

[56] References Cited

UNITED STATES PATENTS

| | | | |
|---|---|---|---|
| 2,354,386 | 7/1944 | Lawler | 74/805 |
| 2,592,237 | 4/1952 | Bradley | 74/571 R |
| 3,056,315 | 10/1962 | Mros | 74/805 |
| 3,074,294 | 1/1963 | Wooley | 74/805 |

*Primary Examiner*—Samuel Scott
*Assistant Examiner*—Wesley S. Ratliff, Jr.
*Attorney, Agent, or Firm*—Oblon, Fisher, Spivak, McClelland & Maier

[57] ABSTRACT

The present invention relates to a driving apparatus for oscillation of a mold within a continuous casting machine and includes an eccentric shaft, having an eccentric shaft portion, rotatably mounted upon a frame, and an eccentric sleeve mounted upon the eccentric shaft portion. The eccentric sleeve is operatively connected to a mold oscillating system through means of a connecting rod, a first shaft connected to the eccentric shaft, a second shaft connected to the eccentric sleeve, and a clutch for rotating the eccentric shaft and the eccentric sleeve at different rates of revolution by means of a change-over transmission interposed between the two shafts so as to thereby change the oscillation amplitude of the connecting rod. According to the invention, the oscillation amplitude can thus be changed by remote control.

3 Claims, 5 Drawing Figures

DRIVING APPARATUS FOR OSCILLATION OF A MOLD WITHIN A CONTINUOUS CASTING MACHINE

BACKGROUND OF THE INVENTION

1. Field of the Invention

The present invention relates generally to a driving apparatus for oscillation of a mold within a continuous casting machine, and more particularly to a driving apparatus which facilitates the remote control alteration of the oscillation amplitude.

2. Description of the Prior Art

Within cast molding apparatus, molds are generally reciprocated in the casting direction, and the reciprocating movement is performed for peeling metal condensed upon a mold in order to prevent sticking of the metal to the mold wall. Furthermore, the oscillation amplitude of the casting mold is appropriately adjusted depending upon the kind of steel and the size of a cast piece in order to improve the quality of the cast piece, especially the surface condition thereof.

As means for accomplishing this adjustment, there has been provided a power transmission mechanism which includes a prime mover, a worm, a worm wheel, an eccentric shaft, an eccentric shaft portion, an eccentric sleeve and a connecting rod, and there have been adopted various arrangements of such components, (1) one such arrangement including discs which are disposed upon the eccentric shaft and the eccentric sleeve, the relative displacements of these eccentric members being manually changed upon the machine side while the operation thereof is stopped. (2) A second arrangement includes a worm final drive gear, to be rotated intermittently in a step by step manner during oscillation, which is secured upon the eccentric shaft and connected to a disc disposed upon the eccentric sleeve, the relative displacements of the eccentric shaft and the eccentric sleeve being changed by driving the worm final drive gear upon the machine side while the operation thereof is stopped. (3) A third arrangement includes a moving fulcrum, interposed between and connected to the power transmission mechanism and the casting mold oscillating mechanism through means of a linkage mechanism whereby the moving fulcrum is shifted so as to obtain the aforenoted adjustment. (4) Lastly, a fourth arrangement includes an eccentric cam per se which is exchanged for accomplishment of the adjustment.

The foregoing arrangements denoted (1), (2) and (4) have proven defective, however, in that automatic remote control is very difficult to practice, and although the amplitude adjustment can be automatically performed by remote control within arrangement (3), the same is practically defective in that accumulation of backlash within the oscillating mechanism is quite extreme, an oscillation of a small amplitude can scarcely be obtained, and another power source is necessary for accomplishing shifting of the moving fulcrum.

Furthermore, as the refractory materials utilized within the continuous casting apparatus should be exchanged within time intervals of 5-6 hours, and at the time of such an exchange operation the casting speed should be decreased, when the casting speed is in fact decreased, the oscillation frequency and oscillation amplitude should also be altered so as to correspond with the decreased casting speed, otherwise, cast pieces having good surface conditions cannot be obtained. According to conventional techniques, however, only the oscillation frequency is permitted to be altered during the casting process, and accordingly, development of a continuous casting apparatus within which not only the oscillation frequency, but also the oscillation amplitude, can be altered during the casting process, has been needed and desired within the art.

In accordance with such apparatus, there is apparatus of broadly this type disclosed within U.S. Pat. No. 3,292,215, however, this conventional apparatus is seen to be quite similar to the apparatus noted in connection with that of category (1), hereinabove, and it is additionally noted that its structure is quite complex. Accordingly, the operation involves various practical difficulties, and the apparatus is defective in that remote control is impossible and the amplitude of oscillation cannot be adjusted during operation thereof.

SUMMARY OF THE INVENTION

Accordingly, the present invention has been developed as a result of research work made with a view to developing an apparatus free of the foregoing defects and disadvantages characteristic of the conventional techniques and apparatus.

Another object of the present invention is to provide a driving apparatus for oscillation of a mold within a continuous casting apparatus, within which the adjustment of the amplitude of oscillation can be automatically performed by remote control.

Still another object of the present invention is to provide a driving apparatus for oscillation of a casting mold within which the amplitude of oscillation can be stably altered throughout a broad range of from a very minute amplitude to a very large amplitude.

Yet another object of the present invention is to provide a driving mechanism for oscillation of a casting mold, within which a very highly precise amplitude can be attained even when the amplitude adjustment is conducted during the casting operation.

In accordance with a first aspect of the present invention for attaining the foregoing and other objects, there is provided a driving apparatus for oscillation of a mold within a continuous casting machine which comprises an eccentric shaft, having an eccentric shaft portion, which is rotatably mounted upon a frame, an eccentric sleeve mounted upon the eccentric shaft portion and being connected to a mold oscillating system through means of a connecting rod, a shaft connected to the eccentric shaft, another shaft connected to the eccentric sleeve, and a clutch for rotating the eccentric shaft and the eccentric sleeve at different rates of revolution by means of a changeover transmission connected to the two shafts, the oscillation amplitude of the connecting rod being altered thereby.

In accordance with a second aspect of the present invention, there is provided an apparatus as set forth in conjunction with the first aspect thereof, wherein the eccentric shaft and the eccentric sleeve are connected to independent drive sources through means of respective deceleration means, the eccentric shaft and the eccentric sleeve being similarly rotated at different rates of revolution.

In accordance with a third aspect of the present invention, there is provided an apparatus as set forth in conjunction with the first aspect thereof, wherein deceleration means is operatively connected to each of the eccentric shaft and the eccentric sleeve, both of the deceleration means are connected to each other through means of a driving shaft having a clutch disposed at an intermediate portion thereof, a by-pass transmission means having a clutch disposed at an intermediate portion thereof is mounted upon the driving shaft, and a drive source is connected to either one of the driving shaft or the bypass transmission means so as to rotate the eccentric shaft and the eccentric sleeve at different rates of revolution by means of the rotative force of the drive source through means of the by-pass transmission means, whereby the oscillation amplitude of the connecting rod is effectively altered.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE ILLUSTRATED EMBODIMENTS

Figure 1:
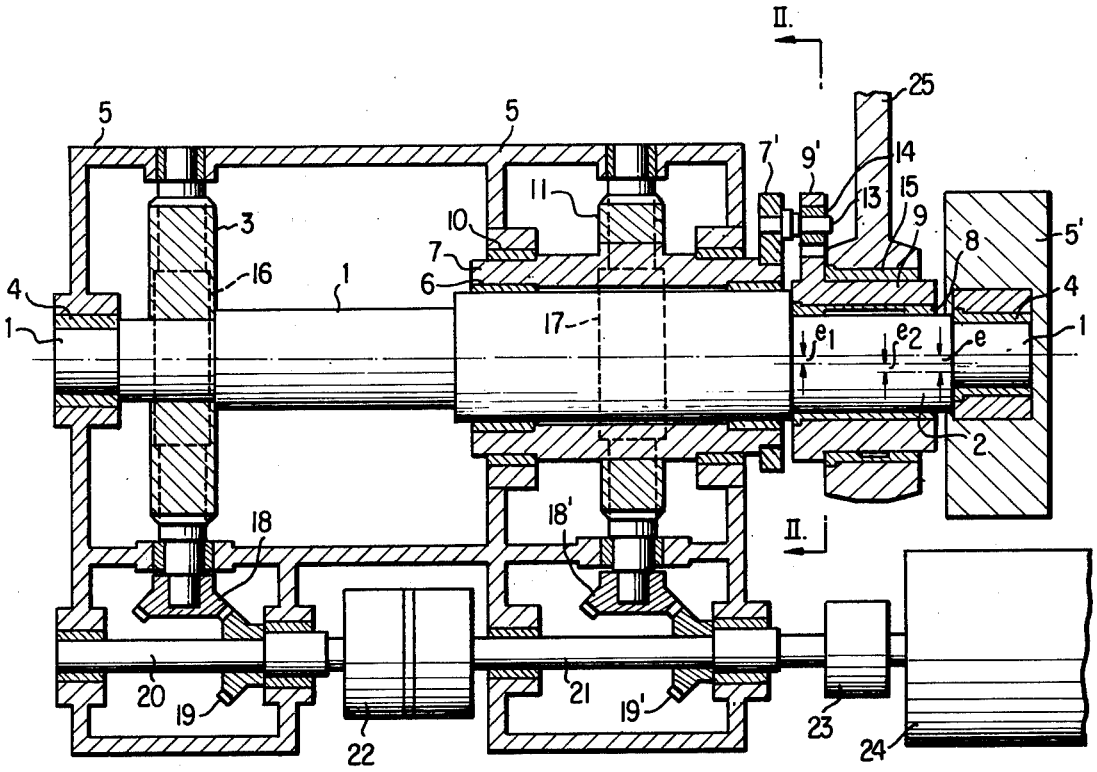
FIG. 1 is a cross-sectional view of one embodiment of the driving apparatus for oscillation of a casting mold constructed in accordance with the present invention and showing its cooperative parts.

Referring now to the drawings and more particularly to FIG. 1 thereof, an eccentric shaft 1 has, at one end thereof, an eccentric portion 2 which is eccentrically disposed, by means of a distance $e_1$, from the center of the shaft, and a worm wheel 3 which is attached to the other end of the shaft 1, both ends being supported within a fixed frame 5 through means of bearings 4. A rotary sleeve 7 is connected to the eccentric shaft 1 at a point adjacent to the eccentric portion 2 through means of an annular sliding member 6, and an eccentric sleeve 9 is similarly connected to, and disposed about the eccentric portion 2, through means of an annular sliding member 8 whereby sleeve 9 is eccentrically disposed, by means of a distance $e_2$, from the axial center of the eccentric portion 2.

Figure 4:
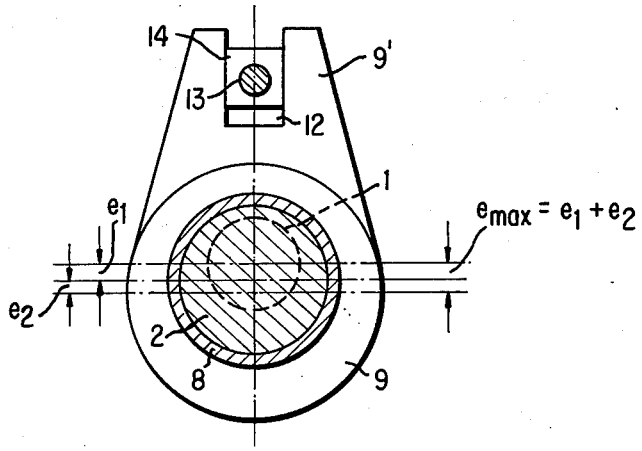
FIG. 4 is a cross-sectional view of the apparatus of either FIGS. 1–3 taken along the line II—II of FIGS. 1–3, showing the state within which the oscillation amplitude of the casting mold is at a maximum value.

The rotary sleeve 7 is supported at both ends thereof upon the fixed frame 5 through means of bearings 10, and has the same axial center as that of the eccentric shaft 1, however the rotary sleeve 7 is so disposed as to be able to rotate around the eccentric shaft independently thereof. A worm wheel 11 is secured to the central portion of the rotary sleeve 7 and a disc 7′ is mounted upon the end of sleeve 7. A pin 13 is secured to disc 7′ and a sliding piece 14, capable of moving within a groove 12 formed upon a disc 9′ integrally formed upon the eccentric sleeve 9, as seen in FIG. 4, is rotatably secured to the pin 13. A connecting rod 25 is secured to the eccentric sleeve 9 through means of a member 15 whereby the same can move in the vertical direction in response to the rotation of the eccentric sleeve 9.

Worm wheels 3 and 11, and worms 16 and 17 to be engaged therewith, are secured to the fixed frame 5, and bevel gears 18 and 18′ are secured to the ends of the worms 16 and 17, respectively. The bevel gears 18 and 18′ are in turn engaged with bevel gears 19 and 19′ which are mounted upon drive shafts 20 and 21, respectively, one end of the drive shaft 20 being connected to one end of the drive shaft 21 through means of a clutch 22, while the other end of the drive shaft 21 is connected to a prime mover 24 through means of a coupling 23. The reduction gear ratio of the pair of bevel gears 18 and 19 is the same as that of the other pair of bevel gears 18′ and 19′, and the reduction gear ratio of the worm 16 and worm wheel 3 is the same as that of the worm 17 and worm wheel 11.

In accordance with the aforementioned structure, during the casting operation, the clutch 22 is connected or engaged, and the bevel gears 19 and 19′ are driven, by means of the prime mover 24, at the same rotational speed. Since the reduction ratio of the bevel gears 18 and 19 is the same as that of the bevel gears 18′ and 19′, the two worms 16 and 17 are rotated at the same speed, and likewise, both worm wheels 3 and 11 are rotated at the same speed. Accordingly, there is no relative movement between the eccentric shaft 1 and the rotary sleeve 7 nor between the eccentric portion 2 and the eccentric sleeve 9. The eccentric portion 2 and eccentric sleeve 9 are rotated with a predetermined fixed eccentricity, and consequently, the connecting rod 25 is oscillated with a predetermined amplitude, no relative movement being effected between the sliding piece 14 and the sleeve 9.

Alteration of the oscillation amplitude of the casting mold, that is, the oscillation amplitude of the connecting rod, is performed in the following manner. Initially, the clutch 22 is disengaged so as to separate the shaft 20 from the shaft 21, and within this state, only the shaft 21 is rotated by means of the driving force of the prime mover 24. Rotation of the rotary sleeve 7, through means of worm 17 and worm wheel 11, causes the eccentric sleeve 9 to experience a relative movement with respect to the eccentric portion 2 through means of the pin 13 and sliding piece 14 attached to the disc 7′ of the rotary sleeve 7, and in this case, the eccentric shaft 1 is not rotated, however, the connecting rod 25 moves somewhat.

Figure 5:
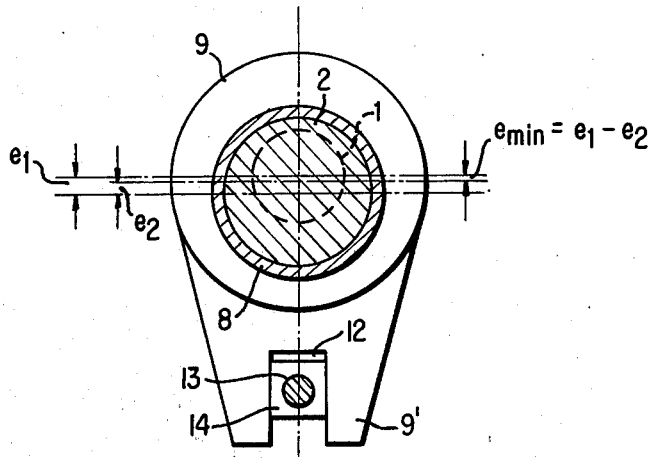
FIG. 5 is a cross-sectional view of the apparatus of either FIGS. 1–3 taken along the line II—II of FIGS. 1–3, showing the state within which the oscillation amplitude of the casting mold is at a minimum value.

In addition, the sliding piece 14 moves in the radial direction within the groove 12 formed upon the disc 9′ of the eccentric sleeve 9, and while the rotary sleeve 7 undergoes one revolution, maximum and minimum amplitudes are inevitably manifested within the connecting rod 25. That is, the maximum amplitude is obtained when the eccentric orientation or direction of the eccentric portion 2 is in agreement or alignment with the eccentric direction or orientation of the eccentric sleeve 9 as shown within FIG. 4, the maximum amplitude corresponding to $e_1 + e_2$. The minimum amplitude is similarly obtained when the eccentric directions or orientations are in agreement or alignment with each other, however the same relatively deviate from each other by $\pi$ or 180°, as shown within FIG. 5, whereby the amplitude corresponds to $e_1 - e_2$.

Figure 2:
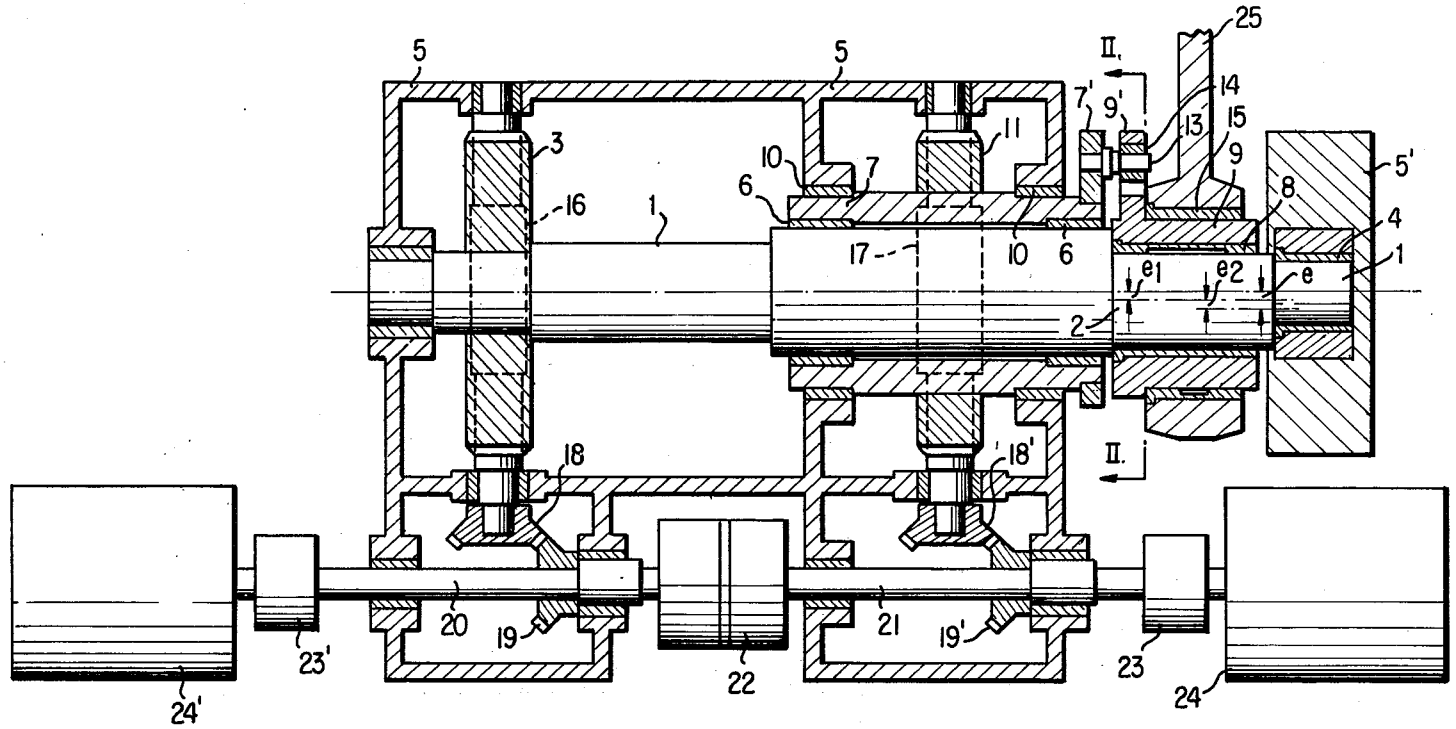
FIG. 2 is a cross-sectional view of another embodiment of the driving apparatus for oscillation of a casting mold constructed in accordance with the present invention.

The present invention is of course not limited to the foregoing embodiment but includes various other modifications, such as for example, the the embodiment disclosed within FIG. 2. In accordance with the structure of FIG. 2, in order to alter the amplitude of the casting mold, the clutch 22 is initially disengaged so as to separate shaft 20 from shaft 21, and the drive shafts 20 and 21 are in fact rotated at different revolution rates by means of providing a difference in the revolution rates between the prime movers 24 and 24'. Accordingly, the eccentric shaft 1 and rotary sleeve 7 are rotated at different revolution rates, and hence, the eccentric sleeve 9 is caused to undergo a relative movement with respect to the eccentric portion 2 through means of pin 13 and sliding piece 14 secured to the disc 7' of the rotary sleeve 7.

In this case, the connecting rod 25 moves somewhat and the sliding piece 14 moves in the radial direction within the groove 12 formed upon the disc 9' of the eccentric sleeve 9. While the rotary sleeve 7 undergoes one revolution, maximum and minimum amplitudes are manifested within the connecting rod 25. The maximum amplitude is of course obtained when the eccentric direction or orientation of the eccentric shaft portion 2 is in alignment with the eccentric direction or orientation of the eccentric sleeve 9 as shown within FIG. 4, such maximum amplitude corresponding to $e_1 + e_2$. The minimum amplitude is similarly obtained when both directions or orientations are in alignment, however are relatively deviated or out of phase with each other by means of $\pi$ or 180°, as shown within FIG. 5.

The relative difference $\Delta w_D$ of the number of revolutions between the eccentric shaft 1 and the eccentric sleeve 9 may be represented as follows:

$$\Delta w_D = 1/i\,[w - (w - \Delta w)] = \Delta w/i$$

wherein: $w$ represents the number of revolutions of the prime mover 24; and $w - \Delta w$ represents the number of revolutions of the prime mover 24'.

Accordingly, the precision of the amplitude setting, alteration, or adjustment is determined solely by the difference in the revolution rates of the prime movers 24 and 24', and therefore, if an appropriate value is set for $\Delta w$, even when the amplitude is altered during the casting operation, a very highly precise amplitude can be obtained regardless of the oscillation frequency.

Figure 3:
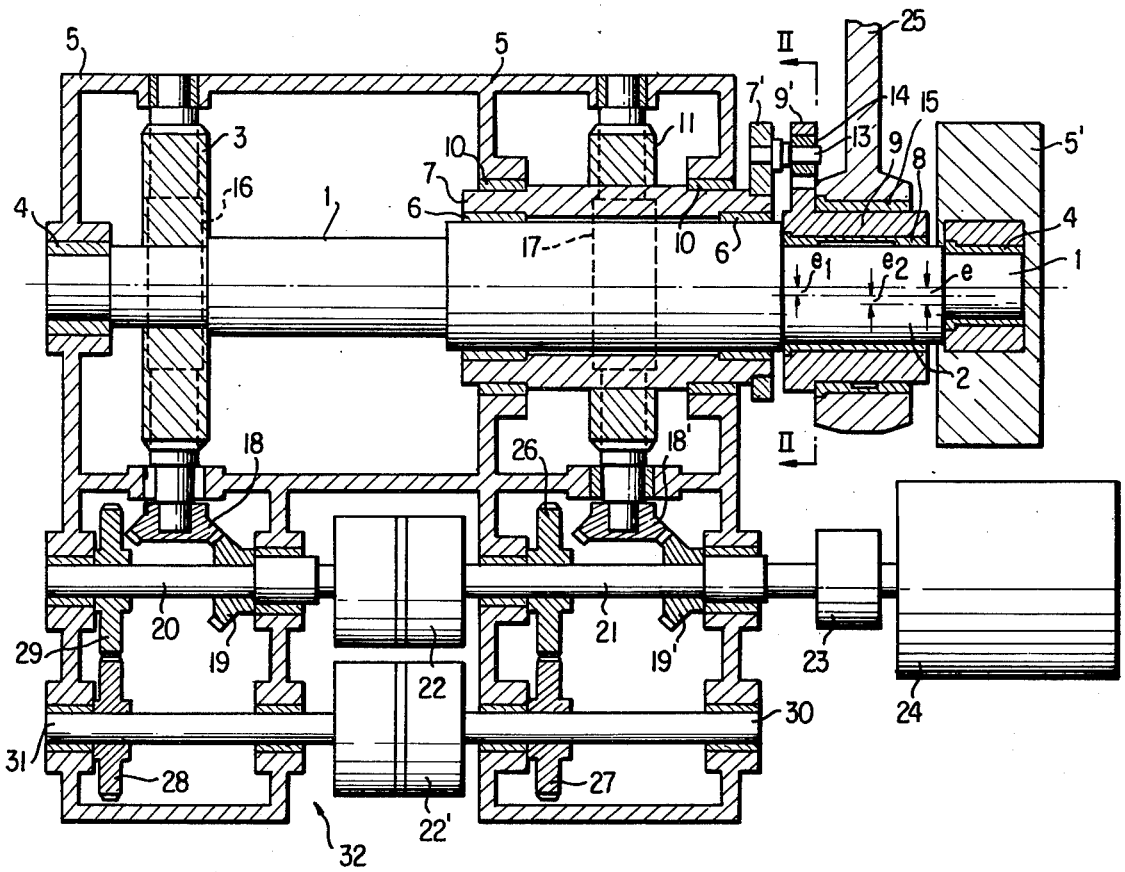
FIG. 3 is a cross-sectional view of still another embodiment of the driving apparatus for oscillation of a casting mold constructed in accordance with the present invention.

Still another embodiment of the apparatus of the present invention will now be described with particular reference being made to FIG. 3. Within the structure shown within FIG. 3, gears 26 and 29 are fixedly secured upon drive shafts 20 and 21, and drive shafts 30 and 31, rotatably mounted upon the lower portion of the fixed frame 5, are connected to each other through means of a clutch 22'. Gears 27 and 28, adapted to be engaged with the gears 26 and 29, are secured to the drive shafts 30 and 31, and thus, a by-pass transmission mechanism, generally indicated by the reference character 32, is in effect comprised of the gears 26, 27, 28 and 29, drive shafts 30 and 31, and clutch 22'.

When the clutch 22 is disengaged, and the clutch 22' is simultaneously engaged, the rotative force of the prime mover 24 is reduced and transmitted to the drive shaft 20 through means of coupling 23, drive shaft 21, gears 126 and 27, drive shaft 30, clutch 22', drive shaft 31, and gears 28 and 29.

In accordance with the aforenoted structure, during the casting operation, that is, during the normal operation, the clutch 22 is engaged, however the clutch 22' is disengaged, and consequently, bevel gears 19 and 19' are driven and rotated at the same rate of speed by means of the prime mover 24. Since the reduction ratio of the bevel gears 18 and 19 is the same as the reduction ratio of the bevel gears 18' and 19', the two worms 16 and 17 are rotated at the same rate of speed and the two worm wheels 3 and 11 are similarly rotated at the same rate of speed. Accordingly, there is no relative movement effected between the eccentric shaft 1 and the rotary sleeve 7 nor between the eccentric shaft portion 2 and the eccentric sleeve 9, although the eccentric shaft portion 2 and the eccentric sleeve 9 are rotated with a predetermined relative eccentricity so as to effect oscillation of the connecting rod 25 with a predetermined amplitude, and in this case, therefore, no relative movement is effected upon the sliding piece 14.

Within this embodiment, the oscillation amplitude of the casting mold, that is, the amplitude of the connecting rod 25, is effected in the following manner. The clutch 22 is initially disengaged so as to separate the shaft 20 from the shaft 21, whereas the clutch 22' is engaged. When the prime mover 24 is operated under these conditions, the rotative force of the prime mover 24 is transmitted to the rotary sleeve 7 at the same revolution rate as in the case of normal operation, however, the rotative force transmitted to the eccentric shaft 1 is reduced by means of the by-pass transmission means 32. Thus, the eccentric shaft 1 and rotary sleeve 7 are rotated at different revolution rates, and therefore, a relative movement is effected between the eccentric sleeve 9 and the eccentric shaft portion 2 through means of pin 13 and sliding piece 14 secured to the disc 7' of rotary sleeve 7. In this case, the connecting rod 25 moves somewhat, and the sliding piece 14 is shifted in the radial direction within the groove 12 formed upon the disc 9' of the eccentric sleeve 9.

If it is assumed that gears 26 and 28 have 51 teeth, and that gears 27 and 29 have 50 teeth, the difference in the number of revolutions that is, the reduction ratio, between the shafts 21 and 20 is expressed as 1 : 1.0404 and the difference in the rotational speed is approximately 4%. In this case, if the oscillation frequency during the casting operation is 100 cpm, the difference in the relative speed between the eccentric shaft 1 and the eccentric sleeve 9 is 4 cpm. Accordingly, it is seen that a very highly precise change in the amplitude can be obtained during the casting operation, even when the apparatus is operated at a high oscillation frequency, and even in view of the fact that the change-over speed of the clutches 22 and 22' is taken into consideration.

As is apparent from the foregoing illustrations, in accordance with the present invention, as a double eccentric mechanism is disposed such that the relative displacment of such double eccentric mechanism is altered by means of a change-over operation of a clutch, adjustment in the amplitude of the casting mold can be automatically performed by remote control.

Furthermore, since the eccentric shaft and the eccentric sleeve are connected to different drive sources through deceleration means, and are rotated at different revolution rates so as to accomplish a predetermined adjustment or change in the amplitude of the casting mold, a very highly precise oscillation amplitude can be obtained even if the adjustment or change in the amplitude is conducted during the casting operation.

Still further, since the adjustment or change in the oscillation amplitude is accomplished by means of rotating the eccentric shaft and the eccentric sleeve at different revolution rates through means of the by-pass transmission, a very highly precise amplitude can be obtained even if the adjustment is carried out during the casting operation. Moreover, since the adjustment of the oscillation amplitude of the casting mold can be performed automatically by remote control, in accordance with the apparatus of the present invention, the adjustment of the oscillation amplitude can be performed while continuing the casting operation.

Still yet further, the apparatus of the present invention has a simple structure and the number of linkage mechanisms thereof can be reduced, whereby a very minute amplitude can be easily obtained.

Obviously, many modifications and variations of the present invention are possible in light of the above teachings. It is to be understood therefore that within the scope of the appended claims the present invention may be practiced otherwise than as specifically described herein.

What is claimed as new and desired to be secured by Letters Patent of the United States is:

1. A driving apparatus for oscillation of a mold within a continuous casting machine, which comprises:

an eccentric shaft, having an eccentric shaft portion, rotatably mounted upon a frame;

an eccentric sleeve mounted upon said eccentric shaft portion and operatively connected to a mold oscillating system through means of a connecting rod;

a first drive shaft operatively connected to said eccentric shaft;

a second drive shaft operatively connected to said eccentric sleeve;

drive means operatively connected to said first and second drive shafts for continuously driving said first and second drive shafts; and clutch means interposed between said first and second drive shafts for controlling the rotation of said first and second drive shafts and, in turn, the rotation of said eccentric shaft and said eccentric sleeve at the same rate of revolution when said clutch means is engaged so as to oscillate said connecting rod with a predetermined amplitude or at different rates of revolution when said clutch means is disengaged so as to thereby continuously alter the oscillation amplitude of said connecting rod.

2. A driving apparatus according to claim 1 wherein:

said eccentric shaft and said eccentric sleeve are connected to independent drive sources through respective deceleration means; and said eccentric shaft and said eccentric sleeve are rotated at different rates of revolution.

3. A driving apparatus according to claim 1 wherein:

deceleration means is operatively connected to each of said eccentric shaft and said eccentric sleeve;

both of said deceleration means are operatively connected to each other through means of said first and second drive shafts having said clutch means disposed at an intermediate portion thereof;

by-pass transmission means, having a clutch disposed at an intermediate portion thereof, is operatively connected to said first and second drive shafts; and said drive means is connected to said first and second drive shafts through either said clutch means or said by-pass transmission means so as to rotate said eccentric shaft and said eccentric sleeve at the same or different rates of revolution, respectively, by means of the rotational force of said drive means.

* * * * *